US007387067B2

(12) United States Patent
Bolza-Schünemann

(10) Patent No.: US 7,387,067 B2
(45) Date of Patent: Jun. 17, 2008

(54) METHOD FOR ADJUSTING A SPRAY DAMPENER

(75) Inventor: Claus August Bolza-Schünemann, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 585 days.

(21) Appl. No.: 10/532,573

(22) PCT Filed: Oct. 21, 2003

(86) PCT No.: PCT/DE03/03487

§ 371 (c)(1),
(2), (4) Date: Apr. 25, 2005

(87) PCT Pub. No.: WO2004/039587

PCT Pub. Date: May 13, 2004

(65) Prior Publication Data

US 2006/0048663 A1 Mar. 9, 2006

(30) Foreign Application Priority Data

Oct. 25, 2002 (DE) ..... 102 50 077
Dec. 13, 2002 (DE) ..... 102 58 325

(51) Int. Cl.
*B41F 7/30* (2006.01)

(52) U.S. Cl. ..... 101/147; 101/132.5; 101/485

(58) Field of Classification Search ..... 101/147, 101/148, 132.5, 351.8, 365, 485, 483
See application file for complete search history.

(56) References Cited

U.S. PATENT DOCUMENTS

| | | | | |
|---|---|---|---|---|
| 2,231,694 | A | 2/1941 | Stevens | |
| 4,469,024 | A | 9/1984 | Schwartz et al. | |
| 4,649,818 | A | 3/1987 | Switall et al. | |
| 4,708,058 | A | 11/1987 | Smith | |
| 4,899,653 | A | 2/1990 | Michl et al. | |
| 5,038,681 | A * | 8/1991 | Hultberg et al. | 101/484 |
| 5,887,521 | A * | 3/1999 | Nakamura et al. | 101/147 |
| 6,327,974 | B1 * | 12/2001 | Belanger et al. | 101/147 |

FOREIGN PATENT DOCUMENTS

| | | |
|---|---|---|
| DE | 1 611 313 | 12/1970 |
| DE | 1 611 313 | 8/1971 |
| DE | 1 761 736 | 5/1972 |
| DE | 1 761 736 | 12/1972 |
| DE | 100 05 908 A1 | 9/2000 |

* cited by examiner

*Primary Examiner*—Ren Yan
*Assistant Examiner*—Kevin D Williams
(74) *Attorney, Agent, or Firm*—Jones, Tullar & Cooper, P.C.

(57) ABSTRACT

A medium, typically a fluid, is supplied at a level of a rotatable body and is dispensed by a dispenser, such as a spray dispenser. The spray dispenser includes at least one spraying nozzle which applies a dampening agent to the roller. A spraying frequency of the spraying nozzle is adjusted with respect to a rotation frequency of the roller that is receiving the dampening agent. This makes it possible to avoid superposition of the dampening agent, at least for a defined number of rotations of the roller receiving the dampening agent.

52 Claims, 2 Drawing Sheets

METHOD FOR ADJUSTING A SPRAY DAMPENER

CROSS-REFERENCE TO RELATED APPLICATIONS

This U.S. patent application is the U.S. national phase, under 35 USC 371 of PCT/DE2003/003487, filed Oct. 21, 2003; published as WO 2004/039587 A1 on May 13, 2004, and claiming priority to DE 102 50 077.0, filed Oct. 25, 2002 and to DE 102 58 325.0, filed Dec. 13, 2002, the disclosures of which are expressly incorporated herein by reference.

FIELD OF THE INVENTION

The present invention is directed to a method for setting up a spray dampening unit A correlation is set between the duration of a period of operation of at least one spray nozzle and the duration of a revolution of a forme cylinder.

BACKGROUND OF THE INVENTION

A dampening unit for use with an offset printing press is known from German Published, Examined Patent application DE 1 611 313. A dampening agent is atomized in a pulse-like manner, and at a selectable pulse length as a function of the number of revolutions of a forme cylinder. This atomized dampening agent is intermittently applied to the surface of a roller of the dampening unit by the use of nozzles. German Published, Examined Patent Application DE 1 761 313 complements DE 1 611 313 to the extent that a pulse length and a pulse sequence frequency can be adjusted. The pulse length is greater at a low printing speed and is shorter at a high printing speed. Alternatively, the number of spray pulses emitted per revolution of the forme cylinder is higher at a low printing speed and is lower at a higher printing speed.

A spray dampening unit of a printing press is known from U.S. Pat. No. 2,231,694. The nozzles eject a dampening agent in an adjustable amount at predetermined chronological intervals onto a dampening roller.

A spray dampening unit of a printing press is known from U.S. Pat. No. 5,038,681. A dampening agent can be applied, by the use of nozzles, to the surface of a roller of the spray dampening unit at a fixed pulse length, but with a variable pulse sequence spacing, which spacing is selected as a function of the number of revolutions of a forme cylinder.

A spray dampening unit of a printing press is known from DE 100 05 908 A1. A surface, preferably of a rotating roller, is sprayed with a dampening agent by a plurality of spray nozzles. The spray nozzles are each activated with a predetermined frequency and phase shift. Thus, the spray nozzles spray sequentially and cyclically in a fixed order, wherein the length of time between the activation of the same spray nozzle is always the same. The pulse length, i.e. the time during which the spray nozzle is open, is also preferably the same for all of the spray nozzles. The circumferential length of the area sprayed on the surface of the roller, and a circumferential spacing between sequential sprayed areas are a function of the work cycle of the spray nozzles and of a surface speed of the roller. However, no discussion is found in DE 100 05 908 A1 as to what conditions must be maintained between the work cycle of the spray nozzles, or the surface speed of the roller, and a duration of the revolution of a forme cylinder in order to achieve as uniform as possible an application of the spray agent to the forme cylinder at a contact point between the roller and the forme cylinder.

A spray dampening unit of a printing press is known from U.S. Pat. No. 4,649,818. An electronic control circuit controls spray nozzles as a function of a detected press speed of the printing press. A frequency of the spraying pulses emitted by the spray nozzles preferably has a non-linear connection with the speed of the press. It is provided, particularly in case of a fault in the electronic control circuit, to set the spraying frequency manually, such as, for example, with the use of graphic aids representing a connection between the speed of the press and a spraying frequency to be set. There is also no suggestion in U.S. Pat. No. 4,649,818 whether, and if so, which condition between the work cycle of the spray nozzles, or the surface speed of a dampening unit roller, must be maintained to achieve as uniform as possible an application of the spray agent to the forme cylinder at a contact point between the dampening unit roller and the forme cylinder.

Spray dampening units, which intermittently release a dampening agent, such as, for example, a water aerosol, through spray nozzles, and which dampening agent wets a rotating roller with moisture, have been employed for years in offset printing presses. This thin water film is transferred, via a further roller or rollers of the spray dampening unit to a printing forme on the forme cylinder. The sprayed roller and subsequent transfer rollers rotate synchronously with the speed of the press as determined by the number of revolutions of the forme cylinder.

A printing process typically requires different amounts of moisture, depending on the speed of the press and the print pattern. The relationship between the speed of the press and the required amount of moisture can be taken from a so-called dampening curve, which dampening curve is a graphic representation of a dampening degree D as a function of the number of revolutions of the forme cylinder. Thus, the dampening curve indicates what dampening degree D is to be set in a dampening agent dispenser, such as, for example, a nozzle in a spray crosspiece. The dampening degree D marks a ratio between a dampening agent throughput to be set at a dampening agent dispenser and a maximum dampening agent throughput.

$$\text{Dampening degree } D = t_{ON}/t_{ON}+t_{OFF}$$

wherein $t_{ON}$=the length of time of the dampening agent throughput and $t_{OFF}$=the length of time of the dampening agent blockage of stoppage.

In addition to the dampening fluid requirement set by the dampening curve, the amount of moisture can be varied by an operator of the printing press and can be set to any arbitrary value within a value ranging between a total blockage or stoppage of the spray nozzles up to their maximum amount of flow-through. In this case, a change in the amount of moisture emitted by the spray nozzle is achieved by the use of the ratio between their spray time $T_{on}$ and off-time $T_{off}$. Actual operations are preferably performed with as constant as possible an "on" time, so that only the "off" time is varied. Thus, the scanning time ratio, or on-time to off-time changes, together with the requirement for an amount of moisture, as well as the spraying frequency $f=1/(T_{on}+T_{off})$. When selecting the spraying on time $T_{on}$, it should be noted that a spray nozzle requires a definite minimum amount of time for forming its spray cone, as well as for the emergence of a defined amount of moisture, so that the spray time $T_{on}$ can therefore not be set arbitrarily low.

Because of the intermittent manner of the spraying of a dampening agent on a surface area of a rotating roller, a serious disadvantage arises. An uneven, and therefore an undesirable overlapping of the sprayed-on dampening agent can arise as a function of the rotating frequency of the sprayed roller and as a function of the spraying frequency of the nozzle onto the sprayed roller. As a result, such an undesirable overlapping of the dampening agent also occurs on the surface area of the forme cylinder if, in case of an unfavorable correlation between the rotating frequency of the roller and the spraying frequency of the nozzle, the same, or at least a part of the same area on the circumference of the roller is sprayed again and again during each revolution of the roller. In the end, too much dampening agent is applied to some areas on the surface of the cylinder, and too little dampening agent is applied to other areas. The rotating frequency of the roller, and the spraying frequency of the nozzle then reach a state which is called beating interference in oscillation technology. An uneven distribution of the dampening agent has extremely negative effects when imprinting a material, because it leads to considerable ink variations on the material to be imprinted. The danger of the occurrence of such a beating interference is considerable, if no appropriate countermeasures are taken, since the number of revolutions of the printing press, as well as the amount of moisture, can be freely selected by the operator. Thus, this undesirable beating interference effect can occur at any arbitrary operational state.

This beating interference effect arises analogously if more than one nozzle is arranged over the length of the roller. In accordance with the above description, the individual nozzles are separately controlled, and exactly the same effect can occur between two adjoining nozzles. Adjoining nozzles may spray at different frequencies because of a different requirement of the amount of moisture existing over the length of the roller, so that a beating interference between the nozzles occurs, and therefore a very uneven application of dampening agent to the roller is the result.

SUMMARY OF THE INVENTION

The object of the present invention is directed to providing a method for setting up a spray dampening unit.

In accordance with the present invention, this object is attained by setting a correlation between the duration of a period during which at least one spray nozzle of a spray dampening unit supplies fluid to a cylinder and the duration of the time of rotation of that cylinder. The duration of the period within which the dampening agent is delivered is comprised of a delivery time of the spray nozzle and an off-time of the spray nozzle. This is set in comparison with the duration of the revolution of the cylinder. During operation of the spray dampening unit, the start of application of the dampening fluid to the cylinder is offset.

The advantages to be gained with the present invention lie, in particular, in that the above-described disadvantageous effects are lastingly counteracted because, at least for a defined number of sequential revolutions of the rotating body to be dampened, and sometimes generally, synchronization with the spraying frequency is prevented for a press speed of the printing press which, though arbitrary, at least does not change at the time of the setting, in order to achieve a distribution of the dampening agent along the circumference of the rotating body which is as uniform as possible, and which therefore is free of interference. The undesired beating interference, i.e. the overlaying of the dampening agent on the same point of the circumference of the rotating body does not occur. A non-interfering spraying frequency is matched to the press speed of the printing press, and also is selected as a function of the distributive behavior of the spray dampening unit in connection with different ranges of rotation frequency of the roller. This non-interfering spraying frequency, which also does not generate interferences, is set, preferably by the use of programming techniques, and is also updated, as required, in particular in the case of a change of the press speed of the printing press. An operation free of beating interference can also be achieved if the on-times and the off-times of the spray nozzles are changed within the scope of defined correlations. The methods in accordance with the present invention permit the setting of the spraying frequency, which settings have a sufficient safe distance of, for example, up to 25%, but at least 10%, of the duration of the period of the rotating bodies, from the preferably inadmissible, but at least undesirable synchronization values. It is possible to warn of the setting of inadmissible, or at least undesirable synchronization values. The correlations, which are to be avoided, can also be completely avoided, for example by programming techniques, because of which the previously required monitoring outlay for a spray dampening unit in operation is reduced. The quality of the printed products produced by an associated printing press is correspondingly increased.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
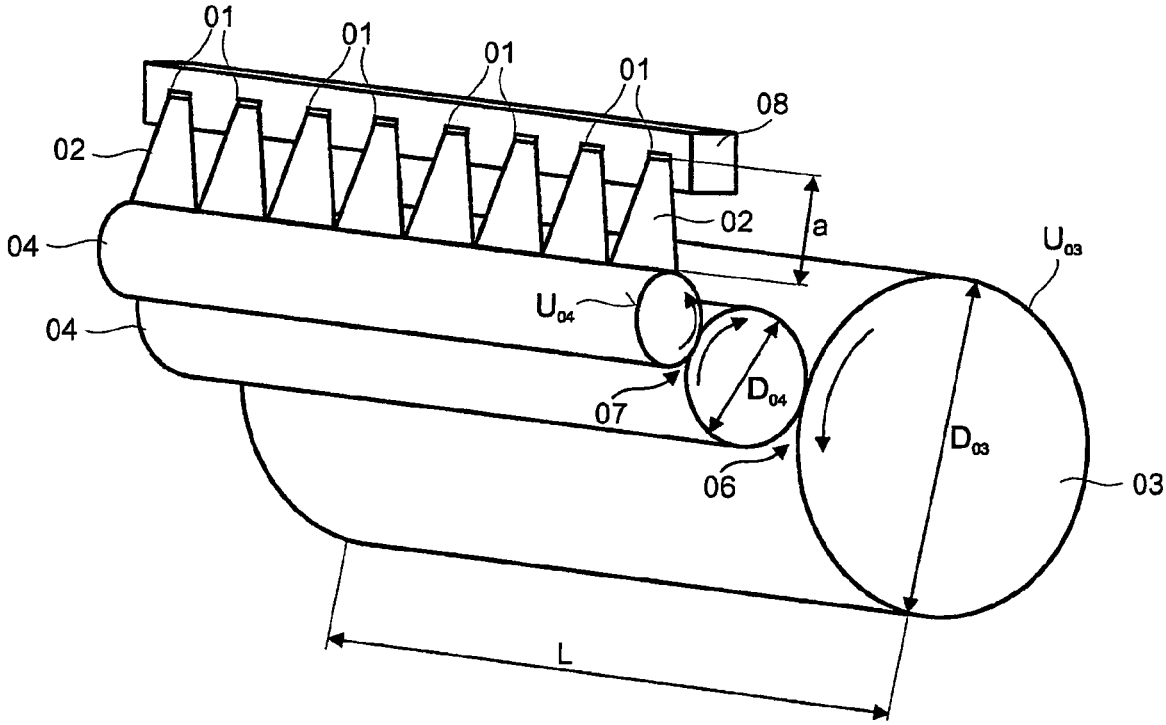
FIG. 1, a perspective plan view of a spray dampening unit represented in greatly simplified form, in FIG. 2, a flow diagram representing the distribution of spraying pulses along a circumferential line of a rotating body, and wherein a repetition length of spraying pulses is less than the duration of the revolution of the rotating body, and in FIG. 3, a flow diagram representing the distribution of spraying pulses along a circumferential line of a rotating body, and wherein a repetition length of spraying pulses is greater than the duration of the revolution of the rotating body.

In a somewhat schematic depiction, FIG. 1 shows a device for distributing a material 02 delivered by a material dispenser 01 along a circumference $U_{03}$ of a rotating first rotating body 03. The material dispenser 01 is arranged fixed in place, at least during its delivery of the material 02, with respect to the rotating body 03. In the course of its rotation, the rotating body 03 receives the material 02, in a discontinuous flow of material, at a contact point 06 on a surface area of the rotating body 03 along its circumference $U_{03}$. As can be seen in the flow diagrams of FIGS. 2 and 3, a duration of the period $T_{A03}$ of the first rotating body 03 for receiving the material 02, or its whole-number multiple $nT_{A03}$, wherein n=1, 2, 3 . . . , is different from a duration of the revolution $T_{03}$ of the first rotating body 03, or its whole-number multiple $nT_{03}$, wherein n=1, 2, 3 . . . . In the course of operation of the material dispenser 01, the material 02 is always available at the contact point 06 in a definite dosage basically only at the end of the duration of the period $T_{A03}$. This duration of the period $T_{A03}$, or of its whole-number multiple $nT_{03}$, wherein n=1, 2, 3 . . . , has been purposely selected to be unlike the actual duration of the revolution $T_{03}$ of the first rotating body 03, or of its whole-number multiple $nT_{03}$, wherein n=1, 2, 3 . . . .

Because of previous incomplete material transfers occurring at prepositioned transfer rollers, in actual use, a partial amount of the defined dosage of the material 02 to be transferred can also again be ready at the contact point 06 at times other than at the end of a complete duration of the period $T_{A03}$, or of its whole-number multiple $nT_{A03}$, wherein n =1, 2, 3 . . . . However, effects caused by such incomplete material transfers will not be considered in this discussion.

Since the material 02 to be dispensed is preferably made available from the material dispenser 01 in the above-described device, the above mentioned basic correlation can be met. The material dispenser 01 dispenses the material 02, in a discontinuous flow amount, in such a way that a duration of the period $T_{A01}$, or of its whole-number multiple $nT_{A01}$, wherein n=1, 2, 3 . . . , is different from the duration of the revolution $T_{03}$ of the first rotating body 03, or of its whole-number multiple $nT_{03}$, wherein n=1, 2, 3 . . . .

Figure 2:
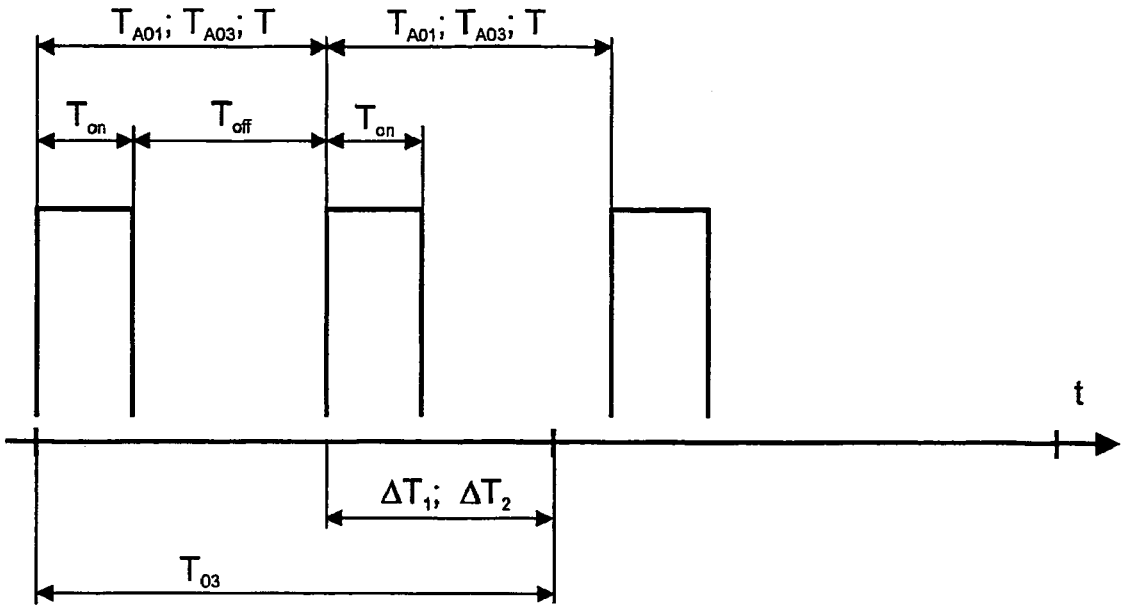

In order to obtain as uniform as possible an application of the material 02 to the surface area of the rotating body 03 in a continuous manner, the following special correlations must be met, in addition to the above-mentioned basic correlations:

If the duration of the period $T_{A01}$ for delivering the material 02, or the duration of the period $T_{A03}$ of the first rotating body 03 for receiving the material 02, or of a whole-number multiple of the duration of these periods $nT_{A01}$, $nT_{A03}$, wherein n=1, 2, 3 . . . , is less than the duration of the revolution of the first rotating body 03, as seen in FIG. 2, a chronological difference $\Delta T_1$ between the duration of the revolution $T_{03}$ of the first rotating body 03 and the duration of the period $T_{A01}$ for delivering the material 02, or the duration of the period $T_{A03}$ for receiving the material 02, or of their whole-number multiple $nT_{A01}$, $nT_{A03}$,wherein n=1, 2, 3 . . . , which chronological difference $\Delta T$, is less than the duration of the revolution $T_{03}$ of the first rotating body 03, should be greater than the duration of a delivery $T_{on}$ (on-time) of the material dispenser 01. Under the assumption that $nT_{A01}$, $nT_{A03}<T_{03}$, wherein n=1, 2, 3 . . . , the following therefore applies:

$$\Delta T_1=T_{03}-(nT_{A01},\ nT_{A03})>T_{on},\ \text{wherein } n=1,\ 2,\ 3\ \ldots$$

Figure 3:
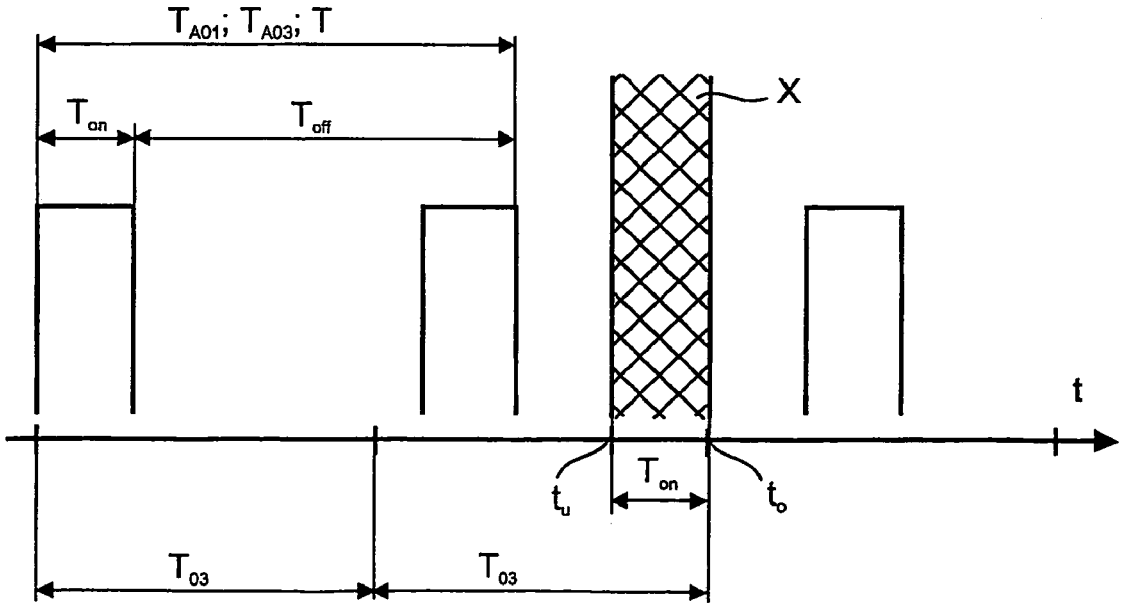

If the duration of the period $T_{A01}$ for delivering the material 02, or the duration of the period $T_{A03}$ of the first rotating body 03 for receiving the material 02, is greater than a whole-number multiple of $nT_{03}$, wherein n=1, 2, 3 . . . , of the duration of the revolution of the first rotating body 03, as seen in FIG. 3, the duration of the period $T_{A01}$ for delivering the material 02 or the duration of the period $T_{A03}$ for receiving the material 02 must not assume a value, or must not be set to a value, which is located in an interval X, whose lower threshold value $t_u$ is formed by the whole-number multiple $(n+1)*T_{03}$, wherein n=1, 2, 3, of the duration of the revolution $T_{03}$ of the first rotating body 03 which next follows the duration of the period $T_{A01}$, $T_{A03}$, reduced by the duration of the delivery $T_{on}$ (on-time) of the material dispenser 01, and whose upper threshold value $t_o$ is formed by the whole-number multiple $(n+1)*T_{03}$ wherein n=1, 2, 3, of the duration of the revolution $T_{03}$ of the first rotating body 03 which next follows the duration of the previously mentioned period $T_{A01}$, $T_{A03}$. Under the assumption that $nT_{A01}$, $nT_{A03}>T_{03}$ , wherein n=1, 2, 3 . . . the following therefore applies:

$$nT_{03}<T_{A01},\ T_{A03}<(n+1)*T_{03}-T_{on},\ \text{wherein } n=1,\ 2,\ 3\ \ldots$$

In the device in accordance with the present invention, the duration of the time of delivery $T_{on}$ of the material 02, which is periodically delivered by the material dispenser 01, within the duration of its period $T_{A01}$, which is being kept constant, can be set to be variable, while at the same time the off-time $T_{off}$ is changed in an opposite manner. The duration of the period $T_{A01}$, while matching the duration of delivery $T_{on}$, or the off-time $T_{off}$, or of both times $T_{on}$, $T_{off}$, can be set to be variable. In this case, the duration of delivery $t_{on}$ of the material 02 which is delivered by the material dispenser 01, and the duration of its period $T_{A01}$, preferably start simultaneously. In other words, the duration of the period $T_{A01}$ respectively begins to count with the start of the duration of delivery $t_{on}$ of the material 02. An advantageous embodiment of the present method and device provides that the duration of the period $T_{A01}$ for delivering the material 02 from the material dispenser 01, or the duration of the period $T_{A03}$ of the first rotating body 03 for receiving the material 02, is at least twice the duration of rotation $T_{03}$ of the first rotating body 03, i.e. $T_{A01}$, $T_{A03}>2*T_{03}$.

If the duration of the revolution $T_{03}$ of the first rotating body 03 differs from the duration of its period $T_{A03}$ for receiving the material 02, the rotating body 03 inevitably picks up the material at different places of its circumference $U_{03}$, at least over a defined number of its revolutions. In some applications, it may not be harmful with respect to the desired distribution, and for accomplishing an as uniform as possible distribution of the material 02 on the surface area of the first rotating body 03 if, starting from a defined number of revolutions, and therefore repetitions of the duration of the revolutions $T_{03}$, for example two, three, five, ten or arbitrarily more revolutions, the material 02 is again applied in its full dosage at the same point of the circumference $U_{03}$ of the first rotating body 03. In a preferred embodiment, the chronological difference $\Delta T_1$ between the duration of the revolutions $T_{03}$ of the first rotating body 03 and the duration of the period $T_{A01}$ for delivering the material 02, or the duration of the period $T_{A03}$ for receiving the material 02, or their whole-number multiples $nT_{A01}$, $nT_{A03}$, wherein n=1, 2, 3 . . . , is, for example, at the most one tenth of the duration of the revolution $T_{03}$ of the first body 03. In the same way, the time window excluded during the interval X from a permissible setting range should preferably be, at most, one tenth of the duration of the revolution $T_{03}$ of the first rotating body 03. Moreover, the duration of the revolution $T_{03}$ of the first rotating body 03 should preferably not be a whole-number multiple of the difference $n\Delta T_1$, or of the interval nX, n=1, 2, 3 . . . in each case. However, these suggested settings for the duration of the chronological difference $\Delta T_1$, or of the interval X, can be adapted to the respective requirements of the printing press.

The material dispenser 01 can deliver the material 02 to at least a second rotating body 04, as seen in FIG. 1, which second rotating body 04 is preferably arranged axially parallel to, and spaced radially with respect to the first rotating body 03. The second rotating body 04 receives the material 02 and transfers the material 02, at a contact point 06 with the first rotating body 03, at least partially to the first rotating body 03. In a further development of this preferred embodiment, it is also possible to provide several second rotating bodies 04, as seen in FIG. 1, such as, for example, five such second rotating bodies 04, which plurality of second rotating bodies 04 constitute a transport chain for the material 02, with this transport chain leading from the material dispenser 01 to the first rotating body 03. One of the second rotating bodies 04 picks up the material 02 delivered by the material dispenser 01 and transfers it, at least partially, to a succeeding second rotating body 04 at a contact point 07. If several of these second rotating bodies 04 are provided, this transfer of material 02 from one second rotating body 04 to the next second rotating body 04 is repeated until the material 02 has reached the first rotating body 03. In the course of this repeated transfer, the amount of the dosage originally delivered by the material dispenser 01 is reduced during every successive transfer to the next rotating body 03, 04 in accordance with generally known laws such as a gap law.

If several second rotating bodies 04 have been provided, they can differ from each other in their diameters $D_{04}$ or in the durations of their respective revolutions $T_{04}$. Also, the diameter $D_{04}$ of at least one second rotating body 04 can be less than the diameter $D_{03}$ of the first rotating body 03, as seen in FIG. 1. For example, the rotating bodies 03, 04 can each have a diameter $D_{03}$, $D_{04}$ of from 140 mm to 420 mm, with, for example, the diameter of the first rotating body 03 preferably being between 280 mm and 340 mm, and the diameter of the second rotating body or rotating bodies 04 preferably being between 140 mm and 200 mm. The axial length L of the rotating bodies 03, 04 lies, for example, in a range of between 500 mm and 2400 mm, and preferably lies between 1200 mm and 1700 mm. If the first rotating body 03 and the second rotating body 04 have different diameters $D_{03}$, $D_{04}$, the duration of rotation $T_{03}$ of the first rotating body 03, and the duration of rotation $T_{04}$ of the second rotating body can have a ratio with respect to each other, which corresponds to the quotient of the diameters $D_{03}$, $D_{04}$. This ratio is applicable particularly in the case where the rotating bodies 03, 04 are coupled with each other by friction or by a gear. This also applies, in a corresponding manner, to several such second rotating bodies 04 of different diameters $D_{04}$. However, the rotating bodies 03, 04 can also be driven separately and independently of each other.

Since the duration of the revolution $T_{03}$ of the first rotating body 03, or the duration of the revolution $T_{04}$ of the second rotating body 04, with their respective diameters $D_{03}$, $D_{04}$ are in a fixed relationship, the above mentioned correlations can also be set as a function of the diameters $D_{03}$, $D_{04}$.

If the material dispenser 01 initially delivers the material 02 to a rotating second rotating body 04, the correlations discussed above, with respect of the durations of the revolutions $T_{03}$ of the first rotating body 03 also preferably correspondingly apply to the correlation between the duration of the period $T_{A01}$ for delivering the material 02 from the material dispenser 01, and the duration of the revolution $T_{04}$ of that second rotating body 04 to whose surface area the material 02 is delivered by the material dispenser 01.

It is of advantage if a total time T, consisting of the duration of the period $T_{A01}$ for delivering the material 02 from the material dispenser 01 to the second rotating body 04, and a duration of the time of transport $T_{TR}$ needed by the at least one second rotating body 04 from its reception of the material until its at least partial material transfer to the first rotating body 03, is not equal to a whole-number multiple of the length of time of the revolution $nT_{03}$, wherein n=1, 2, 3 . . . , of the first rotating body 03. The duration of the time of transport $T_{TR}$, which corresponds to the time of passage of the material 02 through the device, is a function of the number of the second rotating bodies 04 which are provided and of their respective durations of revolution $T_{04}$, as well as of the arrangement of the contact points 06, 07 for transferring the material 02 from one rotating body 03, 04 to the next. This time of transport is the time required for traveling the path along a circumference $U_{04}$ of the second rotating bodies 04, which exists between the individual contact points 06, 07. Accordingly, the following applies:

$$T=T_{A01}+T_{TR}\neq nT_{03}, \text{ wherein } n=1, 2, 3 \ldots.$$

Corresponding to the previously mentioned correlations, it is also of advantage if a chronological difference $\Delta T_2$ between the duration of the revolution $T_{03}$ of the first rotating body 03 and the total time T is greater than a duration of delivery $T_{on}$ of the material dispenser 01, provided the total time T, or even a yet to be determined whole-number multiple of this total time nT, wherein n=1, 2, 3 . . . is less than the duration of the revolution $T_{03}$ of the first rotating body 03. In the same way, it preferably applies that, in connection with the proposed device, the total time T takes on a value, i.e. is set to a value, which lies outside of an interval X, whose lower threshold value $t_u$ is formed by a whole-number multiple $(n+1)*T_{03}$, wherein n=1, 2, 3 . . . , of the duration of the revolution $T_{03}$ of the first rotating body 03, which next follows the total time T, and is reduced by the duration of delivery $t_{on}$ of the material dispenser 01, and whose upper threshold value to is formed by the whole-number multiple $(n+1)*T_{03}$ wherein n=1, 2, 3 . . . , of the duration of the revolution $T_{03}$ of the first rotating body 03, which next follows the total time T, if the total time T is greater than a whole-number multiple $(n+1)*T_{03}$, wherein n=1, 2, 3 . . . , of the duration of the revolution $T_{03}$ of the first rotating body 03, which directly precedes the lower threshold value $t_u$.

In an actual embodiment of the method in accordance with the present invention, the first rotating body 03 is, for example, a forme cylinder 03 of a printing press, and preferably is a forme cylinder 03 of an offset rotary printing press. The at least one second rotating body 04 is embodied as a roller 04 of, for example, an inking unit or of a dampening unit, and in particular of a spray dampening unit, which spray dampening unit is part of the printing press. The material 02 delivered from the material dispenser 01 is a printing substance and, in particular is a dampening agent 02. This material 02 is preferably capable of being sprayed, for example in the form of an aerosol, which material 02 is applied discontinuously and is metered in its amount, preferably by spraying, from a distance "a" to a moving surface, preferably to a rotating surface area of a rotating body 03, 04. The material dispenser 01 is preferably configured as a nozzle 01, wherein the nozzle 01 preferably ejects the material 02 in a pulsed manner and therefore ejects the material 02 intermittently. Several, preferably identical material dispensers 01, which are, for example, in the form of several nozzles 01 that are preferably spaced apart at equal distances on a spray crosspiece 08, as seen in FIG. 1, can be arranged in the axial direction of the first rotating body 03 or in the axial direction of the at least one second rotating body 04.

The duration of the period $T_{A01}$ for delivering the material 02 is composed of the duration of delivery $T_{on}$ of the material dispenser 01 and an off-time $T_{off}$ of the material dispenser 01, as seen in FIGS. 2 and 3. In this case, the duration of the time of delivery $T_{on}$ of the material dispenser 01, its off time $T_{off}$, or both times $T_{on}$, $T_{off}$ can preferably be set to be variable, in particular by remote control from a control console that is assigned to the printing press. The duration of the time of delivery $T_{on}$ of the material dispenser 01, its off time $T_{off}$, or both times $T_{on}$, $T_{off}$, are set in such a way that the desired correlation between the duration of the period $T_{A01}$ for delivering the material 02 and the duration of the revolution $T_{03}$ of the first rotating body 03, or the duration of the revolution $T_{04}$ of the second rotating body 04 is met, if necessary by also taking into consideration the duration of transport $T_{TR}$ of the material 02 through the spray dampening unit. Thus, this setting takes place as a function of the duration of revolution $T_{03}$ of the first rotating body 03, or of the duration of revolution $T_{04}$ of the second rotating body 04. This setting and, if required its updating, is preferably performed by the use of programming techniques, such as, for example, with the aid of a program which determines at least one value-based setting for each possible value of the duration of revolution $T_{03}$ of the first rotating body 03, or of the duration of revolution $T_{04}$ of the second rotating body 04, which meets the required correlation. In this case, the program only allows one permissible setting, which meets the required correlations, while an operator of the printing press is at least warned about unfavorable or about impermissible settings, provided the program itself does not eliminate a setting not meeting the required correlations as impermissible. In this way, the program effectively prevents an undesired beating interference with respect to the application of the material.

Up to now, the chronological behavior of the proposed device has been described by stating the duration $T_{on}$, $T_{off}$, $T_{03}$, $T_{04}$, $T_{A01}$, $T_{A03}$, T, $T_{TR}$, $\Delta T_1$, $\Delta_2$, or its multiple. It is generally known, to one of skill in the art, that the same purpose can be accomplished by citing corresponding frequencies, because these physical values are indirectly proportional to each other (f=1/T).

A rotating frequency $f_{03}$ of the first rotating body can preferably reach approximately 15 Hz from a dead start, which rotating frequency corresponds to a number of revolutions of more than 50000 revolutions per hour. In connection with a printing press, the latter reference is also called its press speed. In a preferred embodiment of the present invention, the depicted device is embodied as a spray dampening unit, whose spray nozzles 01, which may be, for example, eight in number, are arranged fixed in place with respect to a rotating second rotating body 04, such as, for example, a dampening unit roller, in the axial direction in relation to the second rotating body 04 and at a distance "a" of, for example from 80 mm to 150 mm from the second rotating body 04 as seen in FIG. 1. The duration of the delivery time $T_{on}$ of a dampening agent 02, which dampening agent 02 is periodically emitted by the spray nozzles 01 in a spray cone which is directed onto the second rotating body 04 and which is widening in the direction toward the second rotating body 04, can be variably set between 5 ms and 30 ms. The duration of the period $T_{A01}$ of the spraying cycle can be varied, including the off time $T_{off}$ of the spray nozzles 01, within a range of between 50 ms and 1200 ms, and preferably between 100 ms and 1000 ms, wherein the following relationship applies: $T_{A01}=T_{on}+T_{off}$.

At a selected or at a predetermined press speed, in other words as a function of the duration of the revolution $T_{03}$ of the first rotating body 03, and also as a function of the duration of the revolution $T_{04}$ of the second rotating body 04, which durations can be affected by a speed ratio between the first rotating body 03 and the second rotating body 04, and based on their different diameters $D_{03}$, $D_{04}$ and, if required, taking into consideration the duration of transport $T_{TR}$, when several second rotating bodies 04 are provided, the duration of the delivery $T_{on}$ or the off time $T_{off}$ of the spray nozzles 01 are set in such a way that the previously discussed correlations are met. For each press speed and press configuration advantageous correlations result. There are also those correlations which are to be avoided, so that as uniform as possible a distribution of the dampening agent, on the surface area of the first rotating body 03, takes place. For the control of the spray dampening unit, the determined correlations define, besides the basic requirement of the inequality of $T_{A01}$, $T_{A03}$, T and $T_{03}$ either a further requirement, if it applies, that $nT_{A01}$, $nT_{A03}$, $nT<T_{A03}$, wherein n=1, 2, 3 . . . , or an exclusion criteria, if $T_{A01}$, $T_{A03}$, $T>nT_{A03}$, wherein n=1, 2, 3 . . . By keeping the preferred correlations, it is possible to insure that a homogeneous film of a layer thickness of, for example, from 1 μm to 10 μm, and in particular between 1 μm and 2 μm, is assured on the surface area of the forme cylinder 03 in particular.

The preferred correlations should be maintained, if possible, over the entire range of the press speed, but most preferably should be maintained at least in the upper third of the press speed, which is in the main production range of the printing press. For example, in case of a double-wide, double circumference rotary printing press, such as, for example a newspaper printing press, with a maximum number of revolutions of 45000 revolutions per hour, for example, this means that because of being programmed, the control assures that the desired correlations in accordance with the present invention, starting at a press speed of 30000 revolutions per hour, are dependably maintained.

While a preferred embodiment of a method for adjusting a spray dampener, in accordance with the present invention, has been described fully and completely hereinabove, it will be apparent to one of skill in the art that various changes in, for example, the source of supply of the dampening fluid, the particular structure of the material dispensers, and the like could be made without departing from the true spirit and scope of the present invention, which is accordingly to be limited only by the appended claims.

What is claimed is:

1. A method for setting a correlation between a duration of a period of a spray dampening unit and a duration of a revolution of a cylinder including:

providing a spray dampening unit having at least one spray nozzle and adapted to deliver a dampening agent in discontinuous flow amounts;

operating said spray dampening unit over a period with a duration and within which said dampening fluid is delivered;

including in said duration of said period, over which said spray dampening unit is operating, a spray nozzle delivery time and a spray nozzle off-time;

providing a cylinder having a circumference receiving said dampening agent from said spray dampening unit during said period in which said spray dampening unit is in operation;

determining a characteristic of said cylinder;

setting said duration of said period over which said spray dampening unit is operating in accordance with said cylinder characteristic; and applying said dampening agent to said cylinder in accordance with said setting for applying said dampening agent to said cylinder circumference in a complete dosage and starting at a same location on said circumference no earlier than at each third successive revolution of said cylinder.

2. The method of claim 1 wherein said characteristic of said cylinder is a duration of cylinder revolution.

3. The method of claim 1 wherein said characteristic of said cylinder is a diameter of said cylinder.

4. The method of claim 1 further including applying said dampening agent to said same location on said circumference no earlier than each tenth successive revolution of said cylinder.

5. The method of claim 1 wherein said duration of said period within which said dampening fluid is delivered during operation of said spray dampening unit does not correspond to the duration of the revolution of the cylinder.

6. The method of claim 1 further including fixing said at least one spray nozzle fixed in place with respect to a circumference of said cylinder at least during delivery of said dampening agent.

7. The method of claim 6 further including delivering said dampening agent to said cylinder circumference during rotation of said cylinder.

8. The method of claim 1 further including providing a dampening agent roller and using said dampening agent roller for transferring said dampening agent to said cylinder and providing said cylinder as a forme cylinder.

9. The method of claim 1 wherein at least one of said spray nozzles delivery time and said spray nozzle off-time is variable.

10. The method of claim 1 further including providing said duration of said period within which said dampening fluid is delivered variable.

11. The method of claim 1 further including determining a duration of said revolution of said cylinder; determining said duration of said period within which said dampening fluid is delivered; delivering a first chronological difference between said revolution duration and said period duration; and selecting said chronological difference greater than said spray nozzle delivery time when said period duration is less than said revolution duration.

12. The method of claim 1 including setting said duration of said period within which said dampening fluid is delivered based on a duration of a previous period within which said dampening fluid was delivered by providing a time interval having a lower threshold value formed by a whole number multiple of a duration of said revolution of said cylinder reduced by a duration of said spray nozzle delivering time which next follows said previous period, and an upper threshold value formed by said whole number multiple of said duration of said revolution of said cylinder which next follows said previous period, said duration of said period within which said dampening fluid is delivered falling outside of an interval having said lower threshold limit and said upper threshold limit when said duration of said period within which said dampening fluid is delivered is greater than said whole number multiple of said duration of revolution of said cylinder which directly precedes said lower threshold value.

13. The method of claim 1 further including a plurality of dampening unit rollers in said spray dampening unit and further including a duration of transport required by at least one further dampening unit roller between its receipt of dampening agent and its transfer to a forme cylinder and further wherein a total time including said duration of said period within which said dampening agent is delivered and said duration of transport is unequal to a whole number multiple of said duration of a revolution of said cylinder.

14. The method of claim 1 further including applying said dampening agent to said cylinder as a layer having a thickness of between 1 μm to 10 μm.

15. The method of claim 9 further including providing at least one of said spray nozzle delivery time, said spray nozzle off-time and their sum for obtaining said correlation between said duration of said period of said spray dampening unit and said duration of said revolution of said cylinder.

16. The method of claim 15 further including setting at least one of said spray nozzle delivery time, said spray nozzle off-time and their sum as a function of said duration of said rotation of said cylinder.

17. The method of claim 15 further including providing said cylinder as a forme cylinder and further providing a dampening unit roller having a diameter different from a diameter of said forme cylinder and further including setting at least one of said spray nozzle delivery time, said spray nozzle off-time and their sum taking into consideration said difference between said forme cylinder diameter and said dampening unit diameter.

18. The method of claim 1 further including starting said duration of said period of said spray dampening unit and said spray nozzle delivery time at the same time.

19. The method of claim 1 further including selecting at least one of said duration of a period of said spray dampening unit and said duration of a period of said cylinder for receiving said dampening agent being at least double said duration of revolution of said cylinder.

20. The method of claim 11 further including providing said chronological difference being no greater than one-tenth of said revolution duration.

21. The method of claim 12 further including providing said interval no greater than one-tenth of said duration of said revolution of said cylinder.

22. The method of claim 11 further including providing said duration of said rotation of said forme cylinder unequal to a whole number multiple of said chronological difference.

23. The method of claim 12 further including providing said duration of said rotation of said forme cylinder unequal to a whole number multiple of said interval difference.

24. The method of claim 1 further including at least one dampening unit roller and using said at least one spray nozzle for delivering said dampening agent to said at least one dampening roller and from there to said cylinder at a contact point with said cylinder.

25. The method of claim 1 further including providing several dampening unit rollers and using a first one of said dampening unit rollers for receiving said dampening agent from said spray nozzle and for transferring said dampening agent to a subsequent one of said dampening unit rollers at a contact point.

26. The method of claim 25 further including providing said several dampening unit rollers having one of differing diameters and durations of revolution.

27. The method of claim 24 further including providing said at least one dampening fluid roller having a diameter less than a diameter of said cylinder.

28. The method of claim 11 further including providing a dampening unit roller having a duration of revolution of said dampening unit roller.

29. The method of claim 12 further including providing a dampening unit roller having a duration of revolution of said dampening unit roller.

30. The method of claim 1 further including providing a range of said duration of said revolution of said cylinder and setting said duration over which said spray dampening unit is operating over at least an upper third of said range.

31. The method of claim 1 further including providing a range of said duration of said revolution of said cylinder and setting said duration over which said spray dampening unit is operating over all of said range.

32. The method of claim 1 further including providing a dampening unit roller and further including a duration of transfer required by said dampening unit roller between its receipt of said dampening agent and its transfer to said cylinder and further wherein a total transfer time including said duration of said period within which said dampening agent is delivered to said dampening unit roller and said duration of transport is unequal to a whole number multiple of said duration of said revolution of said cylinder.

33. The method of claim 32 further including selecting a time differential between said duration of revolution of said cylinder and said total time being greater than said spray nozzle delivery time when said total time is less than said duration of revolution of said cylinder.

34. The method of claim 32 further including providing said total time as a value lying outside of an interval having a lower threshold value formed by a whole number multiple of said duration of said revolution of said cylinder which next follows said total time and which is reduced by said spray nozzle delivery time, and having an upper threshold formed by a whole number multiple of said duration of said revolution of said cylinder which next follows said total time when said total time is greater than a whole number multiple of said duration of said revolution of said cylinder directly preceding said lower threshold value.

35. The method of claim 1 further including at least one dampening unit roller arranged axially spaced from said cylinder.

36. The method of claim 1 further including operating said at least one spray nozzle for ejecting said dampening agent in a pulse-like manner.

37. The method of claim 1 further including providing a plurality of said spray nozzles and arranging said plurality of spray nozzles arranged spaced apart from each other in an axial direction of said cylinder.

38. The method of claim 9 further including providing a remote control and using said remote control for varying at least one of said spray nozzle delivery time and said spray nozzle off-time.

39. The method of claim 1 further including providing a program for determining at least one of said spray nozzle delivery time, and said spray nozzle off-time as a function of said value of said diameter of revolution of said cylinder.

40. The method of claim 39 further including providing said program excluding settings not meeting required correlations.

41. The method of claim 39 further including providing said program excluding settings not meeting required correlations.

42. A method for setting a spraying frequency of a spray dampening unit including:

providing at least one spray nozzle;

using said at least one spray nozzle for spraying a dampening agent;

providing a roller;

using said at least one spraying nozzle for applying said dampening agent to said roller;

determining a characteristic of said roller;

setting a spraying frequency of said spray nozzle as a function of said roller characteristic for avoiding overlaying of said sprayed-on dampening agent, at least for a defined number of subsequent rotations of said roller receiving said dampening agent; and selecting said defined number of subsequent rotations being at least two.

43. The method of claim 42 further including selecting said characteristic of said roller as a rotational frequency of said roller.

44. The method of claim 42 further including selecting said characteristic of said roller as diameter of said roller.

45. The method of claim 42 further including providing a plurality of spray nozzles spaced in an axial direction of said roller.

46. The method of claim 42 further including setting said spraying frequency for avoiding overlap of said sprayed-on dampening agent for two subsequent rotations of said roller.

47. The method of claim 42 further including setting said spraying frequency for avoiding overlap of said sprayed-on dampening agent for five subsequent rotations of said roller.

48. The method of claim 42 further including setting said spraying frequency for avoiding overlap of said sprayed-on dampening agent for ten subsequent rotations of said roller.

49. The method of claim 42 further including setting said spraying frequency for avoiding overlap of said sprayed-on dampening agent for an indeterminate number of subsequent rotations of said roller.

50. The method of claim 42 further including using said spray nozzle for spraying said dampening agent along a circumference of said roller.

51. The method of claim 1 further including using said spray dampening agent in an offset rotary printing press.

52. The method of claim 42 further including using said spray dampening agent in an offset rotary printing press.

* * * * *